United States Patent [19]

Moore

[11] 4,393,975

[45] Jul. 19, 1983

[54] REFRIGERATED LIP STICK CONTAINER

[76] Inventor: Constance R. Moore, 8351 E. Rose La., Scottsdale, Ariz. 85253

[21] Appl. No.: 364,524

[22] Filed: Apr. 1, 1982

[51] Int. Cl.[3] ..... B65D 85/72

[52] U.S. Cl. ..... 206/385; 62/530; 62/457

[58] Field of Search ..... 62/530, 457; 206/385

[56] References Cited

U.S. PATENT DOCUMENTS

| | | | |
|---|---|---|---|
| 3,053,381 | 9/1962 | Schmid | 206/385 |
| 4,183,226 | 1/1980 | Moore | 62/530 |
| 4,311,022 | 1/1982 | Hall | 62/530 |
| 4,324,111 | 4/1982 | Edwards | 62/530 |

FOREIGN PATENT DOCUMENTS

| | | | |
|---|---|---|---|
| 19855 | of 1929 | Australia | 62/530 |

*Primary Examiner*—Joseph Man-Fu Moy
*Attorney, Agent, or Firm*—Harry M. Weiss

[57] ABSTRACT

This disclosure relates to an apparatus for retaining and refrigerating a lip stick container. A case having a cover fastened to a bottom section includes a retainer for holding the lip stick dispenser. The retainer defines a compartment between the case and the lip stick dispenser. A reusable refrigerant is then placed within the container to keep the lip stick dispenser at a cool temperature.

6 Claims, 3 Drawing Figures

REFRIGERATED LIP STICK CONTAINER

BACKGROUND OF THE INVENTION

1. Field of the Invention

This invention relates generally to carrying cases for lip stick dispensers, and more specifically, to a carrying case which includes a refrigerant for keeping the lip stick cool in hot weather.

2. Description of the Prior Art

In the past, containers for lip stick such as a lip stick dispenser, were not fabricated for the purpose of keeping the cream inside the dispenser cool. As a result, in hot climates, one would find the lip stick to be warm or melted or cracked.

This problem was especially troublesome to women who carried lip stick dispensers in their purse. If the purse was left in the car on a hot day or the lip stick dispenser was otherwise exposed to heat, the woman would find her lip stick melted or cracked and unusable.

The need existed to provide an improved lip stick container which would prevent a lip stick from melting or cracking upon normal exposure to hot weather.

SUMMARY OF THE INVENTION

This invention includes an apparatus for retaining and refrigerating a lip stick dispenser. The apparatus includes a case and a means for retaining within the case the lip stick dispenser. In addition the retainer means defines a chamber between the case and the lip stick dispenser. A refrigerant is contained within the chamber defined by the case and retainer means, for refrigerating the lip stick dispenser.

It is an object of this invention to provide a refrigerated lip stick container which prevents various lip stick dispensers from exposure to heat.

It is another object of this invention to provide a refrigerated lip stick container wherein the refrigerant is reusable.

Other objects will be clear from the description and claims that follow.

DETAILED DESCRIPTION OF THE PREFERRED EMBODIMENT

Figure 1:
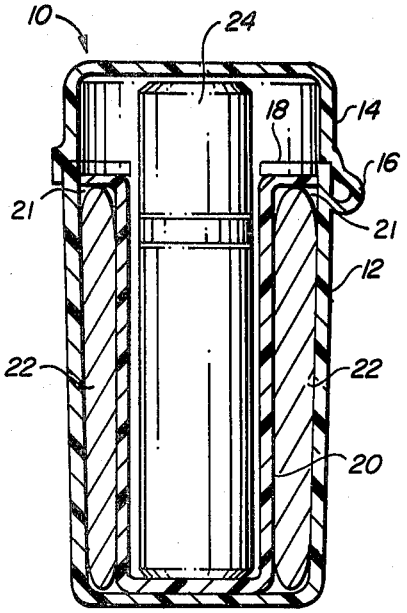
FIG. 1 is a cross sectional view of the invention retaining a lip stick dispenser.
Figure 2:
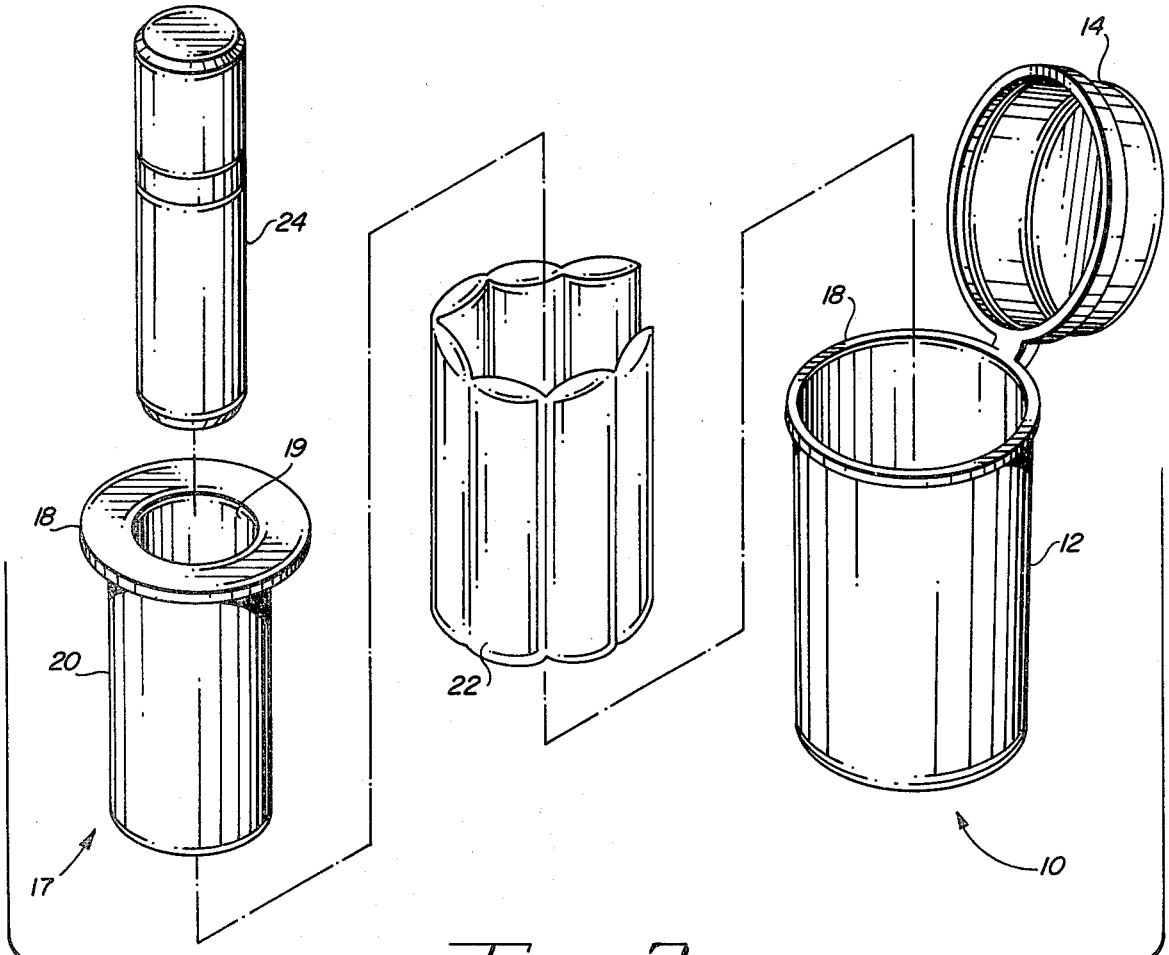
FIG. 2 is an exploded view of the invention shown in FIG. 1.

Referring to FIG. 1 and FIG. 2, a case is referenced generally by the numeral 10. The case 10 is comprised of a cover 14 fastened to the bottom section 12 by a hinge 16. Ideally, the case 10 can be molded in one-piece from plastic. Within the case 10 is a retainer means referenced generally by the numeral 17 for retaining the skin cream dispenser. The retainer means 17 is comprised of a planar surface 18 defining an aperture 19 and connected to a cylindrical compartment 20. The retainer means 17, also, can be molded in one piece from plastic.

The retainer means 17 also defines a compartment 21 between the case and the skin cream dispenser. Within the compartment 21 is a refrigerant 22. As can be seen in FIG. 2 a suitable refrigerant can be sealed in a flexible jacket. Suitable refrigerants are Cryogel (trademark owned by 3M company) or Blue Ice (trademark owned by Diverjex company).

The invention as shown in FIG. 1 and FIG. 2 is adapted for containing a lip stick dispenser 24. The aperture 19 defined by the planar surface 18 is of diameter smaller than the case 10, but larger than the dispenser 24. Similarly, the diameter of the compartment 20 is smaller than the case 10, but larger than the dispenser 24.

Figure 3:
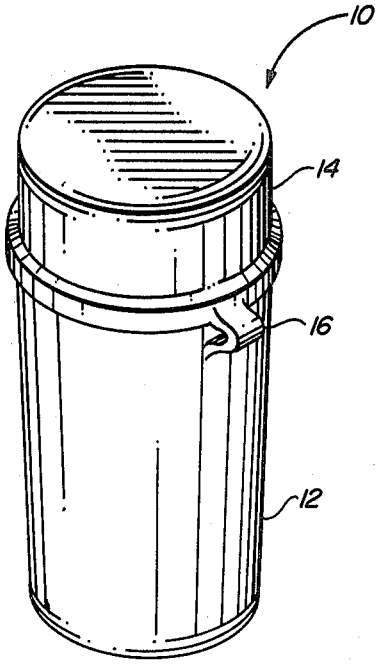
FIG. 3 is a top perspective view of the case.

The refrigerant is frozen prior to use and placed in the bottom section 12 of case 10. The dispenser 24 is then placed with compartment 20 of the retainer means 17. The retainer means 17 retaining the lip stick dispenser 24 is then placed with the bottom section 12 of the case 10. The cover 14 is then closed as shown in FIG. 3. The effect of the refrigerant 22 is to keep the lip stick dispenser 24 cool regardless of the temperature outside the case 10.

While the invention has been particularly shown and described with reference to preferred embodiments thereof, it will be understood by those skilled in the art that the foregoing and other changes in form and details may be made without departing from the spirit and scope of the invention.

What is claimed is:

1. An apparatus for retaining and refrigerating a lip stick dispenser comprising:

(a) a case;

(b) a lip stick dispenser located in said case, said lip stick dispenser having a lipstick located therein;

(c) retainer means for retaining within said case said lip stick dispenser, said retainer means defining a chamber between said case and said lip stick dispenser;

(d) cover means for closing said case to protect said lip stick dispenser; and (e) a refrigerant contained within the chamber defined by said retainer means and located around said lip stick dispenser, said case and said cover means enclosing both said refrigerant and said lip stick dispenser together therein.

2. An apparatus as defined in claim 1 wherein said cover means comprises a cover hingedly fastened to a top portion of said case.

3. An apparatus as defined in claim 1 wherein said refrigerant comprises a freezing gel; said freezing gel being contained in a flexible jacket.

4. An apparatus as defined in claim 3 wherein said freezer gel is comprised of a product known by the trademark Cryogel (owned by the 3M company).

5. An apparatus as defined in claim 3 wherein said freezing gel is comprised of a product known by the trademark Blue Ice (owned by the Diverjex Company).

6. An apparatus as defined by claim 1 wherein said retainer means is comprised of:

(a) a planar surface having a diameter substantially equal to the diameter of said case, said planar surface defining an aperture having a diameter smaller than the diameter of said case; and (b) a cylindrical compartment having a diameter substantially equal to the diameter of said aperture, said cylindrical compartment coupled at its opening to said planar surface and aligned with said aperture.

* * * * *